US005592823A

United States Patent [19]

Ginzburg

[11] Patent Number: 5,592,823

[45] Date of Patent: Jan. 14, 1997

[54] VARIABLE SOFT COOLING HEADER

[75] Inventor: Vladimir B. Ginzburg, Pittsburgh, Pa.

[73] Assignees: Danieli United; International Rolling Mill Consultants, Inc., both of Pittsburgh, Pa.

[21] Appl. No.: 614,394

[22] Filed: Mar. 12, 1996

[51] Int. Cl.[6] ..... F25D 17/02

[52] U.S. Cl. ..... 62/64; 62/374; 62/373; 62/63; 266/114

[58] Field of Search ..... 62/64, 63, 121, 62/122, 374, 373; 266/114

[56] References Cited

U.S. PATENT DOCUMENTS

| | | | |
|---|---|---|---|
| 3,339,373 | 9/1967 | Möbius et al. | 62/373 X |
| 4,047,985 | 9/1977 | Greenberger . | |
| 4,098,495 | 7/1978 | Lhenry et al. . | |
| 4,226,108 | 10/1980 | Wilmotte et al. . | |
| 4,407,487 | 10/1983 | Wang . | |
| 4,415,381 | 11/1983 | Tani et al. . | |
| 4,440,584 | 4/1984 | Takeshige et al. . | |
| 4,497,180 | 2/1985 | Graham . | |
| 4,610,144 | 9/1986 | Lawson | 62/374 X |
| 4,899,547 | 2/1990 | Irwin | 62/374 X |
| 4,974,424 | 12/1990 | Tosaka et al. | 62/373 |
| 5,146,759 | 9/1992 | Eguchi et al. | 62/64 |
| 5,186,018 | 2/1993 | Van Ditzhvijzen et al. | 62/374 |
| 5,390,900 | 2/1995 | Ginzburg . | |
| 5,526,652 | 6/1996 | Mantovau | 62/374 |

*Primary Examiner*—Christopher Kilner
*Attorney, Agent, or Firm*—Armstrong, Westerman, Hattori, McLeland & Naughton

[57] ABSTRACT

A method and means for soft cooling a moving heated metal strip comprises forming a descending waterwall extending across the metal strip in a direction perpendicularly to the line of travel of the strip. Air jets, variable in angle to the vertical direction of the descending waterwall, impact the waterwall, converting it to a descending curtain of air-water mist which impinges upon an upper surface of the metal strip to effect soft cooling of the strip.

8 Claims, 1 Drawing Sheet

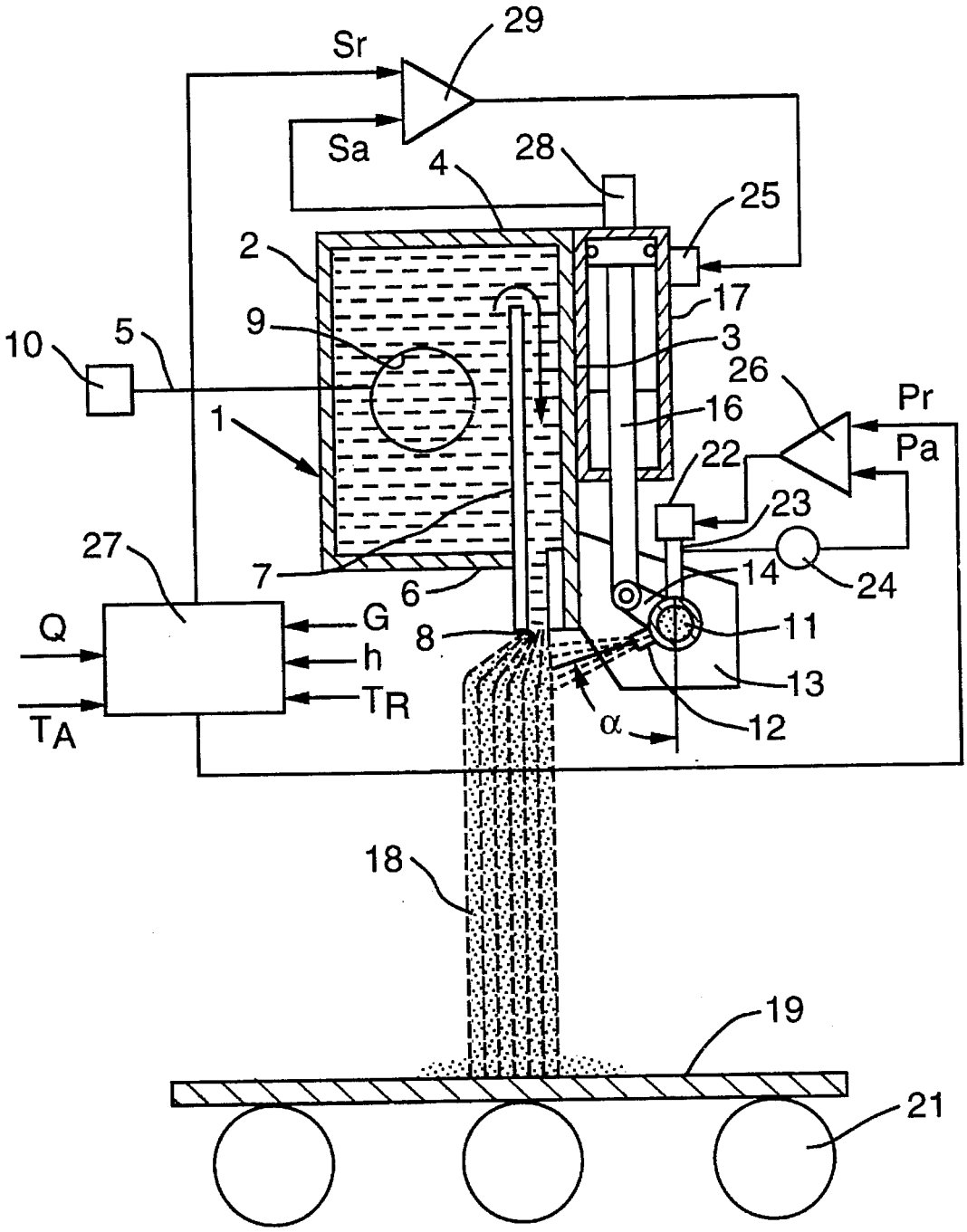
29
Sr
Sa
28
4
25
2
17
9
3
10
5
26
Pr
16
1
Pa
22
23
27
7
6
14
24
Q
G
8
11
h
13
TR
TA
α
12
18
19
21

VARIABLE SOFT COOLING HEADER

BACKGROUND OF THE INVENTION

1. Field of the Invention

This invention relates to the cooling of moving metal strip or sheet, particularly to the soft cooling of such products with a descending water-air mixture.

2. Description of Prior Art

The cooling of moving hot metal strip is old in the art, and commonly is achieved by flooding the hot metal strip with streams of cooling water, for example as shown in U.S. Pat. Nos. 5,390,900; 4,047,985; 4,415,381; 4,440,584, and 4,497,180. Cooling also may be effected by means of air-water sprays. An example is shown in U.S. Pat. No. 4,226,108 in which air-water sprays are directed vertically downwardly onto an upper surface of a moving hot metal strip and upwardly onto a lower surface of the strip. U.S. Pat. No. 4,098,495 shows cooling of a moving metal strip by means of an aerosol flowing across the width of the strip perpendicularly to its path of travel. U.S. Pat. No. 4,407,487 shows cooling of a moving metal strip by means of air-water sprays directed vertically upwardly and downwardly onto the upper and lower surfaces of the metal strip.

This invention is an improvement of the invention disclosed in U.S. Pat. No. 5,390,900, which is assigned to the assignee of the present invention and which is incorporated herein by this reference. That patent discloses a metal strip cooling system in which a descending stream of liquid water, from a waterwall cooling header, is used to cool a hot metal strip moving perpendicularly past the water stream. Variable cooling across the width of the strip is achieved by interposing a deflector, in the form of a slidable plate, in the path of the flow of air directed toward the water stream thereby to interrupt a portion of the air stream whereby a portion of the descending water stream is undiverted and contacts the moving metal strip to cool it, while another portion of the water stream is diverted by the air stream into a water collector.

SUMMARY OF THE INVENTION

This invention employs apparatus similar to that of U.S. Pat. No. 5,390,900 to provide a wall of water descending from a water header vertically toward an upper surface of a moving strip of metal at an elevated temperature. The descending wall of water is impacted by an angularly variable air stream to convert the wall of water to a descending curtain of air-water mist which is directed onto the upper surface of the moving metal strip to provide a gentle or "soft" cooling of the metal.

BRIEF DESCRIPTION OF THE DRAWING

The drawing is a side elevational view of the apparatus of the invention, showing the descending curtain of air-water mist for soft cooling a moving heated metal strip.

DESCRIPTION OF PREFERRED EMBODIMENTS

In the drawing, the numeral 1 generally designates a waterwall cooling header comprising side walls 2 and 3, end walls (not shown), top wall 4 and bottom wall 6. A vertically-extending wier 7 is provided inside the header 1 and spaced from side wall 3 and defining therewith an opening 8 directed vertically downwardly for forming a descending stream of water from header 1. Water enters header 1 through a feed pipe 9 which connects with a water supply line 5 in which is located a flow meter 10 to determine the flow rate of water through header 1 and out of opening 8.

An air header 11, extending across the width of the strip 19, and having a plurality of air nozzles 12 serially spaced along the length of the header, is rotatably mounted on air header support bracket 13, and is connected, by means of crank arm 14, to a piston rod 16 of a hydraulic cylinder 17 regulating the angular position of the air header 11. Air streams from air nozzles 12 impact on the water stream exiting from opening 8, thereby forming a descending curtain of air-water mist 18 which impinges on a strip of heated metal 19 moved along a line of travel by run out table rolls 21.

An air pressure actuator 22 is connected to air header 11 through pipe 23 and the latter is connected, through an air pressure transducer 24, to an air pressure regulator 26 to which is fed an actual air pressure signal $P_a$ from transducer 24 and an air pressure reference signal $P_r$ produced by a soft strip cooling controller 27. A cylinder position transducer 28 is provided and generates a hydraulic cylinder actual position signal $S_a$ which is compared, in cylinder position regulator 29, to a hydraulic cylinder position reference signal $S_r$ from controller 27, which regulates the position of the piston within cylinder 17 by means of a servovalve 25.

In operation, the water flow rate Q, and the strip composition G, thickness h, and actual hot strip temperature $T_a$ and desired cooled strip temperature $T_r$, are inputted into controller 27 which generates cylinder position and air pressure reference signals $S_r$ and $P_r$. These reference signals are compared with actual position and air pressure signals $S_a$ and $P_a$ in regulators 29 and 26 respectively, and air pressure actuator 23 and servovalve 25 correspondingly are activated to set the air pressure within air header 11 and the position of the piston 16 within cylinder 17, hence the angle alpha of the rotatable air header 11 necessary to achieve the desired cooled strip temperature $T_r$.

The invention provides gentle or "soft" cooling of the heated rolled product in order to eliminate cracks and to obtain desired metallurgical microstructure and properties such as hardness and strength. It is especially necessary to provide such soft cooling for steels containing excessive amounts of hydrogen, e.g. in excess of about 5 ppm. The softening effect is achieved by mixing the water exiting waterwall cooling header 1 with the air directed onto the water wall from nozzles 12 in air header 11 to form a curtain of mist 18. Optimum desired performance is achieved by proper regulation of the air pressure and angular position of air header 11 as functions of the product material grade, G, product material thickness, h, product material temperature T, and water flow rate Q, as input signals to controller 27. Such regulation can be accomplished experimentally, case-by-case, easily for each value of G, h, T and Q encountered in practice of the invention.

What is claimed is:

1. A method of soft cooling of a moving heated metal strip, comprising forming a waterwall descending vertically in the direction of the metal strip and extending across a width of the strip perpendicularly to a line of travel of the strip, impacting the waterwall with an air stream to convert the water wall to a descending curtain of water-air mist, and directing the curtain of air-water mist onto an upper surface of the heated metal strip to effect soft cooling thereof.

2. A method according to claim 1, wherein pressure of the air stream and an angle of the air stream to the waterwall are varied in relationship to the composition, thickness and actual and desired temperatures of the metal strip, and to the rate of flow of water in order to obtain optimum desired soft cooling of the metal strip.

3. A method according to claim 2, wherein the air stream comprises a plurality of serially-arranged air jets exiting from a rotatable air header extending across a width of the moving metal strip.

4. A method according to claim 3, wherein the air header is rotated to provide an optimum angle of impact of the air jets on the waterwall as a function of air pressure, water flow rate, and the composition, thickness and temperature of the metal strip.

5. A method according to claim 4, further comprising determining water flow rate Q and actual heated strip temperature $T_a$ and inputting signals representing those parameters, along with signals representing strip composition G and thickness h and a desired cooled strip temperature $T_r$, into a cooling controller, measuring actual air pressure $P_a$ in the air header, in the controller generating air pressure reference signal $P_r$, inputting $P_a$ and $P_r$ into an air header position regulator and therein generating a signal actuating an air pressure actuator to set air pressure in the air header, measuring the actual angle alpha of the air header represented by an actual position $S_a$ of a piston rod of an hydraulic cylinder/piston assembly connected to the air header and adapted to rotate the air header, in the controller generating a cylinder position reference signal $S_r$, inputting $S_a$ and $S_r$ into a cylinder piston rod position regulator and thereby regulating a servovalve to actuate the cylinder/piston assembly and to determine an angle alpha corresponding to the desired strip temperature $T_r$ at the predetermined values of $T_a$, G and h.

6. Apparatus for soft cooling of a moving, heated metal strip, comprising a waterwall cooling header having an elongated opening in a bottom wall thereof extending across a width of the metal strip and forming a waterwall descending from the waterwall header toward the metal strip, an air header movably mounted for rotation with respect to the waterwall and extending across the width of the metal strip, means to rotatably move the air header, and a plurality of air jets serially disposed in the air header and adapted, on rotation of the air header, to impact the descending waterwall with air and to convert the waterwall to a curtain of air-water mist directed onto an upper surface of the heated metal strip to soft cool the strip.

7. Apparatus according to claim 6, wherein the means to rotatably move the air header comprises an hydraulic piston/cylinder assembly wherein a piston rod is connected by a crank to the rotatable air header.

8. Apparatus according to claim 7 for soft cooling a strip of composition G, thickness h, and actual strip temperature $T_a$, to a desired strip temperature $T_r$, further comprising means to detect a rate of water flow, Q, an air pressure actuator, an air pressure transducer to detect the air pressure in the air header and to generate an actual air pressure signal, $P_a$, an air pressure regulator to regulate the air pressure actuator, a servovalve to effect the position of the cylinder, a cylinder position regulator to regulate the servovalve, a cylinder position transducer to detect the position of the piston rod of the cylinder and to generate a cylinder actual position signal, $S_a$, for input into the cylinder position regulator, a soft strip cooling controller receiving signals representing Q, G, h, actual strip temperature $T_a$ and desired strip temperature $T_r$ and adapted to generate an air pressure reference signal, $P_r$, for input, together with $P_a$, into the air pressure regulator, and a cylinder position reference signal, $S_r$, for input, together with $S_a$, into the cylinder position regulator.

* * * * *